United States Patent [19]

Bodine

[11] 3,952,800

[45] Apr. 27, 1976

[54] SONIC TECHNIQUE FOR AUGMENTING THE FLOW OF OIL FROM OIL BEARING FORMATIONS

[76] Inventor: Albert G. Bodine, 7877 Woodley Ave., Van Nuys, Calif. 91406

[22] Filed: Mar. 14, 1974

[21] Appl. No.: 450,989

[52] U.S. Cl. ..... 166/249; 166/303; 166/263

[51] Int. Cl.[2] ..... E21B 43/24; E21B 43/25

[58] Field of Search ..... 166/249, 272, 303, 305, 166/311, 263, 53, 75, 177, 224

[56] References Cited

UNITED STATES PATENTS

| | | | |
|---|---|---|---|
| 956,058 | 4/1910 | Elten | 166/303 |
| 1,152,392 | 9/1915 | Breitung et al. | 166/303 |
| 2,281,751 | 5/1942 | Cloud | 175/1 X |
| 2,421,528 | 6/1947 | Steffen | 166/303 UX |
| 2,667,932 | 2/1954 | Bodine, Jr. | 166/177 X |
| 2,680,485 | 6/1954 | Bodine, Jr. | 166/177 X |
| 2,700,422 | 1/1955 | Bodine, Jr. | 166/249 |
| 2,866,509 | 12/1958 | Brandon | 166/249 X |
| 3,339,635 | 9/1967 | Brandon | 166/249 |

*Primary Examiner*—Stephen J. Novosad
*Attorney, Agent, or Firm*—Edward A. Sokolski

[57] ABSTRACT

High level sonic energy is introduced at the head of an oil well casing and transmitted through the gaseous column formed in the casing down to oil bearing strata from which oil is being extracted. The sonic energy is transmitted into this strata either through the opening in the bottom of the casing and/or apertures in the casing wall, the sonic energy operating to heat the oil particles so as to reduce their viscosity and to induce the migration of oil particles from the oil bearing strata, as well as to clear the interstices of the formation of flow impeding particles, thereby augmenting the flow of oil in the well. The basic process is enhanced by heating the gas within the casing and/or pressurizing the gas.

9 Claims, 2 Drawing Figures

Figure 1:
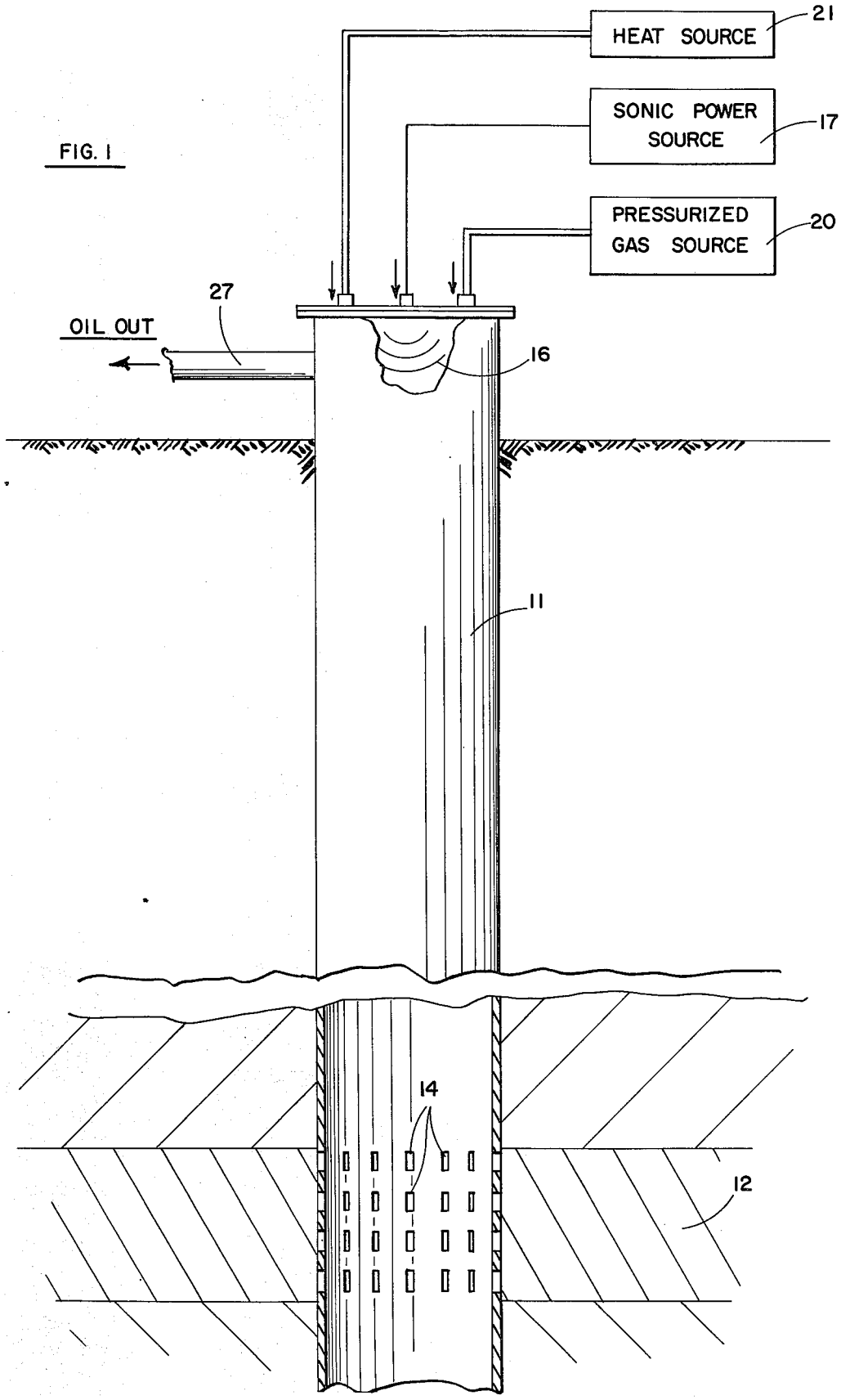

HEAT SOURCE
21
SONIC POWER SOURCE
17
PRESSURIZED GAS SOURCE
20
27
OIL OUT
16
11
14
12

SONIC TECHNIQUE FOR AUGMENTING THE FLOW OF OIL FROM OIL BEARING FORMATIONS

This invention relates to a technique for augmenting the flow of oil from an oil well, and more particularly to such a technique utilizing sonic energy which is transmitted to the oil bearing strata from the surface portions of the well through the gas within the oil well column.

In the production of oil it has been found that the flow from a well can be augmented by applying sonic energy in the region of the oil producing formation. This has the effect of heating the oil and thus reducing its viscosity. Also, the sonic energy affects the permeability of the formation and induces the migration of oil particles from the oil bearing strata. It also operates to clear the interstices of the formation of flow impeding particles. All of the aforementioned effects contribute to an increase in the flow of oil.

In my U.S. Pat. No. 3,578,081, a technique along these lines is described in which sonic transducers are clamped to the walls of the oil well casing portions which are in the region of the oil bearing strata, the sonic energy being radiated by the casing walls into the strata. With this technique, considerable energy is dissipated in the casing with its inherent energy losses and metal fatigue of the casing. Further, the installation of the transducer down near the bottom portions of the well involves significant expense and installation work.

An earlier technique for the augmentation of oil well yield is described in my U.S. Pat. No. 3,378,075. In one embodiment of this patent, the sonic energy is coupled from a transducer into a fluid in the well bore. This embodiment, as for that of the prior patent, requires the installation of the transducer far down the well bore. Further, as noted in the aforementioned U.S. Pat. No. 3,578,081, the use of liquid as the coupling medium is impractical for use in gas bearing wells.

The technique of the present invention affords advantages over many of those of my aforementioned patents in that the sonic energy is not transmitted through the oil well casing nor through a liquid medium, but rather is transmitted from the head of the oil well casing through the gas column formed within the casing. The approach avoids the dissipation of energy in the oil well casing and other structural elements, and the metal fatigue incidental thereto. Further, with the present technique, the need for installing a sonic transducer or coupler far down the oil well bore as is suggested in the prior art techniques is obviated and an installation can therefore readily and economically be made in both new and existing wells. The present technique is also compatible for use in gas bearing wells.

It is therefore an object of this invention to provide a simpler and more economical technique for augmenting the flow of oil from an oil well.

It is a further object of this invention to provide means for augmenting the flow of oil with a simpler and more economical installation than involved in the prior art.

Figure 2:
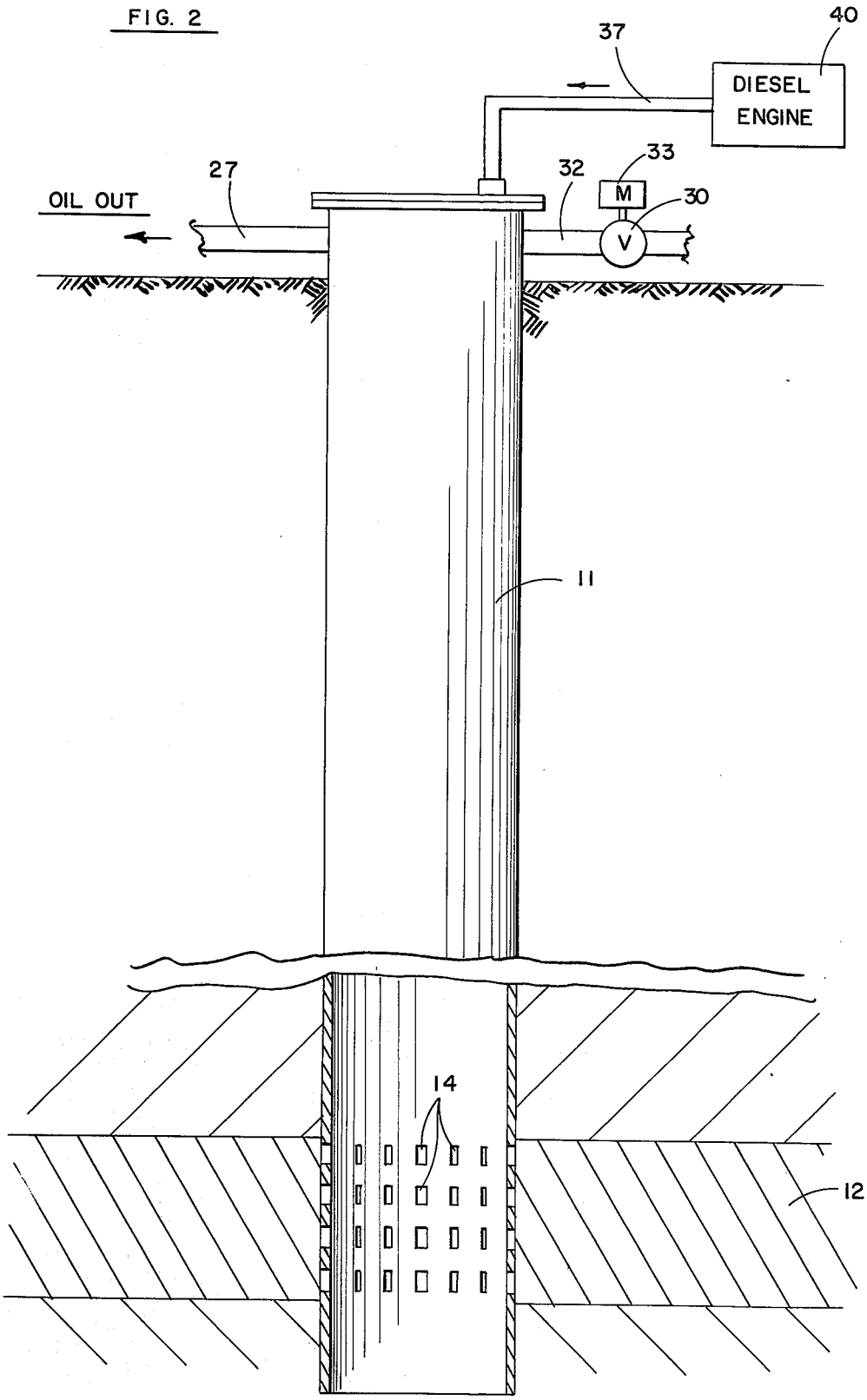

Other objects of the invention will become apparent as the description proceeds in connection with the accompanying drawings, of which:

FIG. 1 is a schematic drawing illustrating the basic features of the invention; and FIG. 2 is a schematic drawing illustrating one embodiment of the invention.

Briefly described, the technique of the invention is as follows: Sonic energy is coupled to the gas medium contained within an oil well casing from a sonic energy source providing such energy at the head of such casing. The sonic energy is transmitted through the gas column formed in the casing down to the region of the oil bearing strata and is transmitted into such strata through apertures in the casing or the open bottom end of the well, as the situation may be. Transmission of the sonic energy through the gaseous medium may be enhanced by pressurizing the gas. Further, heating of the oil bearing strata may be further implemented by heating the gas. In one embodiment, both these enhancements are obtained by using the exhaust of an internal combustion engine as the sonic energy source, the pulsating pressurized and heated exhaust gases being fed from the engine to the interior of the casing at the head thereof.

Referring now to FIG. 1, the technique of the invention is schematically illustrated. Oil well casing 11 has its lower portion penetrating through oil bearing strata 12. Oil flows into the casing from the oil bearing strata through apertures 14 formed in the casing wall. Sonic energy is fed from sonic power source 17 to the gas within casing 11 at the head of the casing, this sonic energy being transmitted through the column of gas as indicated by wave lines 16. Sonic energy is transmitted down through the column of gas within the casing and out through apertures 14 into oil bearing strata 12. It is to be noted that the gas may primarily comprise hydrocarbon vapors and may additionally include air, nitrogen, carbon dioxide, hydrogen sulfide and other gases. This sonic energy should be great enough to provide a level for the energy passing through apertures 14 of the order of 1000 watts generated at source 17, per square foot of aperture area. As to be explained in connection with FIG. 2, sonic power source 17 may comprise an internal combustion engine, the exhaust of which is fed into the space at the head of the casing. The sonic source may alternatively comprise a mechanically driven vibratory diaphragm of known type having large volumetric displacement which is driven vibrationally by an engine or electric motor, this diaphragm being mounted in a gas filled chamber, the sonic output of which is fed into the air space at the head of the well.

To improve the transmission of sonic energy to the gaseous medium, pressurized gas may be fed into the casing from pressurized gas source 20. This pressure can be applied for a predetermined time interval, and then released so as to not maintain a back pressure against inflow of oil. The process can also be enhanced by heating the gas by means of a heat source 21. This may be accomplished, of course, by heating the gas fed from pressurized gas source 20 or may simply involve the placement of a heater at the head of the casing.

As already noted, the sonic energy has three effects: (1) it acts to heat the oil particles in the oil bearing strata, thereby lowering the viscosity of the oil (this being additionally furthered by heating the gas); (2) it tends to increase the permeability effect at the oil bearing strata and cause the oil to more effectively migrate into the well; and (3) it tends to clear out flow impeding particles from the interstices of the oil bearing formation; all of these effects augmenting the flow of oil realized at outlet line 27. The sonic energy may be typically of the order of a few cycles per second, but may also be at a substantially higher frequency. This frequency may be adjusted so as to set up a resonant standing wave in the gas within the well bore, such resonant operation greatly increasing the efficiency of the transmission of the sonic energy to the oil bearing strata.

Referring now to FIG. 2, one specific embodiment of the technique of the invention is illustrated. The exhaust line 37 of diesel engine 40 is coupled to deliver the exhaust gases of the engine into the gas space at the head of the casing. The hot exhaust gases of the engine are fed in a pulsating manner (i.e., in accordance with the successive exhaust of each of the cylinders) into the casing. The gas pulses sonically energize the gas column in the well at the frequency of the engine cycle, maintaining a sustained sonic wave train therein. With a high compression engine such as diesel, particularly high pressure exhaust pulses are provided. This exhaust energy can constitute almost the total power output of the engine such as by early timing of opening of the exhaust valve.

The engine speed can be adjusted to provide exhaust pulses at a frequency whereat resonant standing wave excitation of the gas column will occur, thereby optimizing the efficiency of operation.

As already noted, the sonic energy should be of the order of 1000 watts (generated at the engine exhaust) per square foot of the aperture area through which the sonic energy passes into the oil bearing formation.

The use of an engine exhaust as the sonic energy source additionally provides both the heating and pressurizing effects desirable for more efficiently implementing the invention.

In order to avoid the build up of a back pressure in the well which would impede the delivery of oil, it is highly desirable to periodically release the pressure in the casing. Such pressurization release can be done cyclically at a substantially lower frequency than that of the sonic wave train. This end result may be achieved by means of valve 30 which is installed in pressure release line 32. Line 32 provides an outlet from casing 11 when the valve is open. Valve 30 is driven by low speed motor 33 to cyclically open and close. The valve may be operated to open and close at intervals of, for example, ten seconds. For certain application requirements, valve operation at longer intervals (from a few minutes to a few hours) may be called for.

The technique of this invention thus provides a way for augmenting oil flow which is especially useful for installation in existing wells in that it can be installed with a minimum effort and expense as compared with techniques of the prior art.

While the invention has been described and illustrated in detail, it is to be clearly understood that this is intended by way of example and illustration only and is not to be taken by way of limitation, the spirit and scope of the invention being limited only by the terms of the following claims.

I claim:

1. A method for augmenting the flow of fluid through an oil well casing installed in the ground, said casing having a gas column formed therein which extends from the head of the well down to the region of the source of said fluid, comprising the steps of:

generating high-level sonic energy, and coupling said sonic energy to said gas column at the head of said well, whereby the sonic energy is transmitted down said column and into said formation to provide the high level sonic energy therein, said sonic energy being generated at a frequency such as to set up resonant standing wave vibration within said gas column.

2. The method of claim 1 and additionally including the step of pressurizing the gas column.

3. The method of claim 2 wherein the gas forming said column is additionally heated.

4. The method of claim 3 wherein the gas forming said column is additionally pressurized.

5. The method of claim 1 wherein the pressure inside the casing is cyclically released.

6. The method of claim 5 wherein said cyclical pressure release is accomplished by means of a line having a valve therein and connected to the inside of the casing, said valve being cyclically driven by a motor.

7. The method of claim 1 wherein the sonic energy is generated by an internal combustion engine, the exhaust of the engine being fed to the interior of said casing.

8. A method for augmenting the flow of fluid through an oil well casing installed in the ground, said casing having a gas column formed therein which extends from the head of the well down to the region of the source of the fluid comprising the steps of:

operating an internal combusion engine to generate heated pressurized gas pulses at the exhaust of the engine, coupling the exhaust of said engine to the gas column at the head of the well to sonically energize said gas column, whereby sonic energy is transmitted down said column into said formation, and adjusting the engine speed so as to provide gas pulses at a frequency such as to cause resonant standing wave vibration of said gas column.

9. The method of claim 8 wherein the pressure within said casing is cyclically released.

* * * * *